US009617873B2

(12) United States Patent
Eshak et al.

(10) Patent No.: US 9,617,873 B2
(45) Date of Patent: Apr. 11, 2017

(54) TURBINE EXHAUST CYLINDER / TURBINE EXHAUST MANIFOLD BOLTED STIFFENING RIBS

(71) Applicant: Siemens Energy, Inc., Orlando, FL (US)

(72) Inventors: Daniel M. Eshak, Orlando, FL (US); John Giaimo, Palm Beach Gardens, FL (US); Thomas Heylmun, Palm City, FL (US); Yevgeniy P. Shteyman, West Palm Beach, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 339 days.

(21) Appl. No.: 14/596,763

(22) Filed: Jan. 14, 2015

(65) Prior Publication Data

US 2016/0076396 A1 Mar. 17, 2016

Related U.S. Application Data

(60) Provisional application No. 62/050,236, filed on Sep. 15, 2014.

(51) Int. Cl.

| | |
|---|---|
| ***F01D 25/04*** | (2006.01) |
| ***F01D 25/30*** | (2006.01) |
| ***F01D 25/16*** | (2006.01) |

(52) U.S. Cl.

CPC ..... *F01D 25/30* (2013.01); *F01D 25/04* (2013.01); *F01D 25/162* (2013.01); *F05D 2220/32* (2013.01); *F05D 2230/60* (2013.01); *F05D 2250/281* (2013.01); *F05D 2260/96* (2013.01)

(58) Field of Classification Search

CPC ..... F01D 25/04; F01D 25/162; F01D 25/30; F05D 2220/32; F05D 2230/60; F05D 2260/96

See application file for complete search history.

(56) References Cited

U.S. PATENT DOCUMENTS

| | | | | |
|---|---|---|---|---|
| 3,149,470 | A * | 9/1964 | Herzog | F01D 25/30 60/697 |
| 3,690,786 | A * | 9/1972 | Silvestri, Jr. | F01D 25/30 415/144 |
| 4,802,821 | A * | 2/1989 | Krietmeier | F01D 25/30 415/208.2 |
| 5,203,674 | A * | 4/1993 | Vinciguerra | F01D 25/30 415/208.1 |
| 5,494,405 | A * | 2/1996 | Gray | F01D 25/32 415/211.2 |
| 6,406,252 | B2 * | 6/2002 | Kuhn | F01D 25/30 415/108 |

(Continued)

OTHER PUBLICATIONS

Nelson Stud Welding, Inc., "Stud Welding—CPL Partially Threaded Studs", Nelson Stud Welding, Inc., Standard Stock Products Catalog, Feb. 2004, p. 22.

*Primary Examiner* — Igor Kershteyn

(57) ABSTRACT

Disclosed are a casing arrangement and a method to reduce critical panel mode response in a gas turbine casing. The casing arrangement includes a turbine exhaust cylinder connected to a turbine exhaust manifold establishing a fluid flow path, the fluid flow path including an inner and an outer flow path. A plurality of stiffening ribs are coupled to a surface of the inner flow path which effectively increases the stiffness reducing the critical panel mode response.

20 Claims, 5 Drawing Sheets

(56) References Cited

U.S. PATENT DOCUMENTS

| | | | | |
|---|---|---|---|---|
| 6,419,448 | B1 * | 7/2002 | Owczarek | F01D 1/02 415/207 |
| 7,731,475 | B2 * | 6/2010 | Hardin | F01D 25/30 415/1 |
| 7,785,068 | B2 * | 8/2010 | Rao K V | F01D 25/26 29/888.025 |
| 7,980,055 | B2 * | 7/2011 | Lindenfeld | F01D 25/30 415/126 |

* cited by examiner

TURBINE EXHAUST CYLINDER / TURBINE EXHAUST MANIFOLD BOLTED STIFFENING RIBS

BACKGROUND

1. Field

The present application relates to gas turbines, and more particularly to a casing arrangement to improve component stiffness in a gas turbine, a casing arrangement to reduce operative vibrations, as well as a method to reduce critical panel mode response in a gas turbine casing and a method to reduce operative vibrations in a gas turbine casing.

2. Description of the Related Art

The turbine exhaust cylinder and the turbine exhaust manifold are coaxial gas turbine casing components connected together establishing a fluid flow path for the gas turbine exhaust. The fluid flow path includes an inner flow path and an outer flow path defined by an inner diameter delimiting an outer surface of the inner flow path and an outer diameter delimiting an inner surface of the outer flow path, respectively. Struts are arranged within the fluid flow path and serve several purposes such as supporting the inner and outer surfaces of the flow path and providing lubrication for the turbine and rotor bearing. The exhaust flow around the struts causes vibrations of the inner and outer diameter of the turbine exhaust cylinder and the turbine exhaust manifold due to vortex shedding. Vortex shedding are vibrations induced as the exhaust flows past the struts, where the struts partially obstruct the flow of the exhaust in the inner flow path. These vibrations are a potential contributor to damage occurring to the flow path of the turbine exhaust manifold and the turbine exhaust cylinder. This damage to the casing components may require early replacement or repair.

SUMMARY

Briefly described, aspects of the present disclosure relates to a casing arrangement to improve component stiffness in a gas turbine and a method to reduce critical panel mode response in a gas turbine casing.

A first aspect of provides a casing arrangement to improve component stiffness in a gas turbine component. The casing arrangement includes a turbine exhaust cylinder, a turbine exhaust manifold connected to the turbine exhaust cylinder establishing a fluid flow path, a plurality of stiffening ribs coupled to a surface of the inner flow path effective to increase stiffness and reduce critical panel mode response. The fluid flow path includes an inner and an outer flow path where the flow path is bounded by an outer surface of the inner flow path to an inner surface of the outer flow path.

A second aspect of provides a method to reduce critical panel mode response in a gas turbine casing. The method includes disposing a plurality of stiffening ribs against a flow path of the gas turbine and coupling the plurality of stiffening ribs to the flow path. The flow path is defined by an inner and an outer flow path and is bounded radially inward by an outer surface of the inner flow path and radially outward by an inner surface of the outer flow path. The turbine exhaust cylinder and a turbine exhaust manifold connected to the turbine exhaust cylinder establish the flow path.

DETAILED DESCRIPTION

Figure 1:
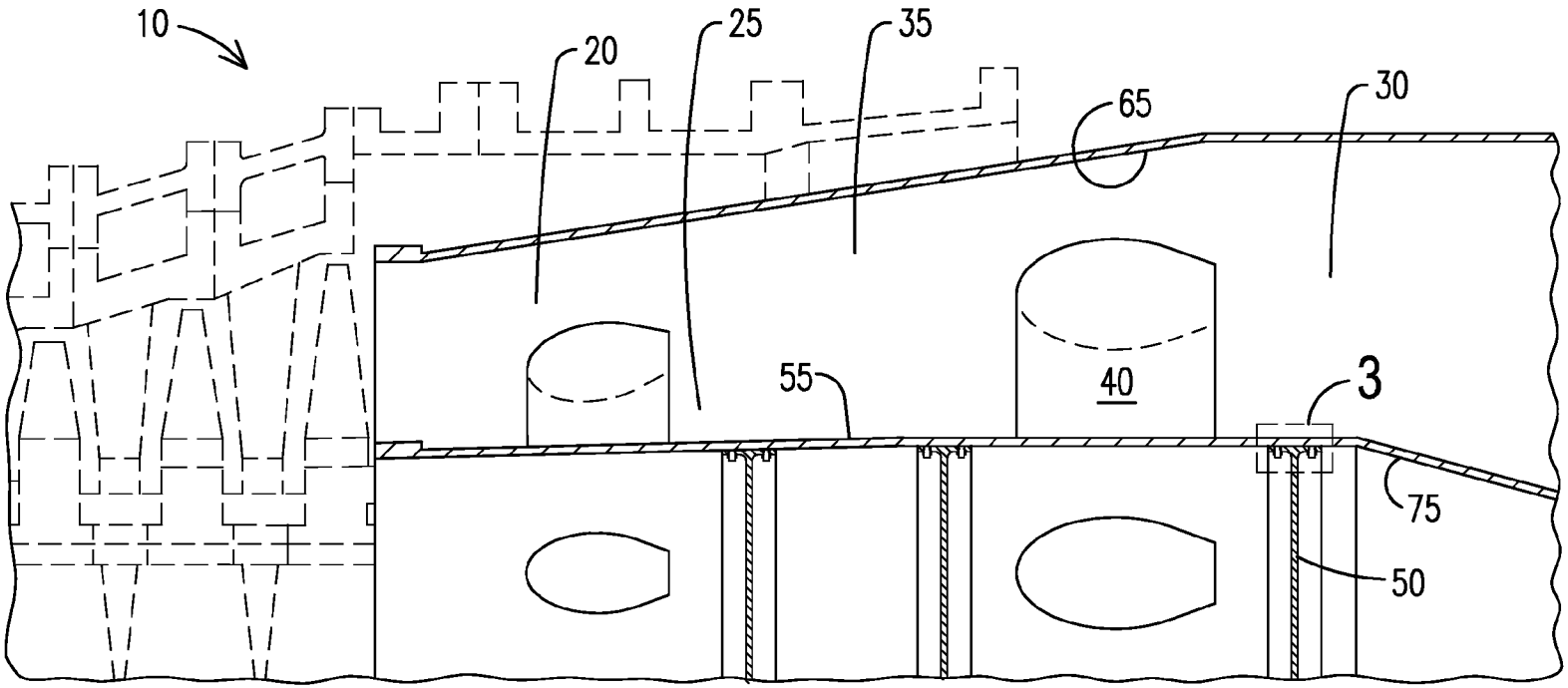
FIG. 1 illustrates a longitudinal cross sectional view of the exhaust system of a gas turbine.

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Damage to gas turbine casing components is an issue that may be caused by vibrations within the inner and outer flow path of the gas turbine exhaust system. The vibrations may be driven by insufficient component stiffness of the turbine exhaust cylinder and/or the turbine exhaust manifold. The stiffness of a component is defined as the rigidity of the component or how well it resists deformations in response to applied forces. Insufficient component stiffness may allow vibrations such as panel modes and/or critical modes to be generated and stay in resonance along with vibrations created by the exhaust flow. Panel modes are mode shapes of panels. Critical modes are mode shapes that couple with the forcing function or energy input and are especially problematic because they may create damage to the casing components, particularly to the flow path of the gas turbine.

One approach to avoid component damage to the casing components caused by vibrations would be to change the vibration frequency away from the critical frequency or resonant frequency. This may be done according to the principle describing natural frequency, $$f_n = \frac{1}{2\pi}\sqrt{\frac{k}{m}}$$

where $f_n$=natural frequency in hertz (cycles/second)

k=stiffness of the spring (Newtons/meter or N/m)

m=mass (kg)

In the gas turbine casing components, the turbine exhaust cylinder and turbine exhaust manifold, the critical frequency typically lies in the range, 120-150 Hz. According to the natural frequency principle, by changing the mass and/and or the stiffness of a component, the natural frequency may be changed. It is from this reasoning that in an embodiment it is proposed to add stiffening ribs to increase the stiffness and change the natural frequency of the casing components outside the critical range to sufficiently avoid a dynamic response issue.

In another embodiment, another approach to avoid component damage to the casing components caused by vibrations would be to introduce a damping mechanism to damp the problematic vibrations and transfer the energy associated with these vibrations to heat energy. The damping mechanism may reduce the amplitude of the vibrations lessening their severity and capacity to damage the casing components. Existing insulation positioned on the inner surface of the inner flow path used to insulate components outside of the flow path against the heat of the flow path may also be used to provide the damping mechanism. The layers of insulation may be preloaded, or compressed, an amount to provide sufficient damping to damp the unwanted vibrations while not disintegrating the insulation.

FIG. 1 illustrates a longitudinal cross sectional view of the exhaust system (10) of a gas turbine. The turbine exhaust system (10) is disposed in the aft portion of the turbine section of the gas turbine and includes a turbine exhaust cylinder (20) and a turbine exhaust manifold (30). The turbine exhaust manifold (30) is connected downstream from the turbine exhaust cylinder (20) and establishes a fluid flow path, the fluid flow path includes an inner (25) and outer flow path (35). The path is bounded radially inward by an outer surface (55) of the inner flow path and radially outward by an inner surface (65) of the outer flow path. Struts (40) are hollow tubes that may extend between the inner flow path to the outer flow path.

In the shown embodiment, stiffening ribs (50) are coupled to the inner surface (75) of the inner flow path and are positioned axially along the flow path. As previously stated, changing the stiffness of a component, in this case the flow path of the exhaust system of a gas turbine, may be used to change the vibration frequency away from the critical frequency. Illustrated in FIG. 2, a cross sectional view of the exhaust system flow path shows the stiffening ribs (50) in a circumferential continuous hoop. From this view, it may be seen that the struts (40) extend tangentially from the outer surface (55) of the inner flow path to the inner surface (65) of the outer flow path. The stiffening ribs (50) are coupled to the inner surface of the inner flow path (75) in a circumferential manner. A bolted connection plate (60) is disposed between adjacent stiffening ribs (50) in order to connect the stiffening ribs (50) and form the continuous stiffening hoop. The rotor of the gas turbine would be positioned within the continuous stiffening hoop. A plurality of continuous stiffening hoops may be positioned axially along the inner surface of the inner flow path (75) at locations where the critical and/or panel modes may cause damage to gas turbine components. One skilled in the art would also understand that the plurality of stiffening ribs (50) may be positioned in a discontinuous circumferential manner without the bolted connection plates.

Figure 3:
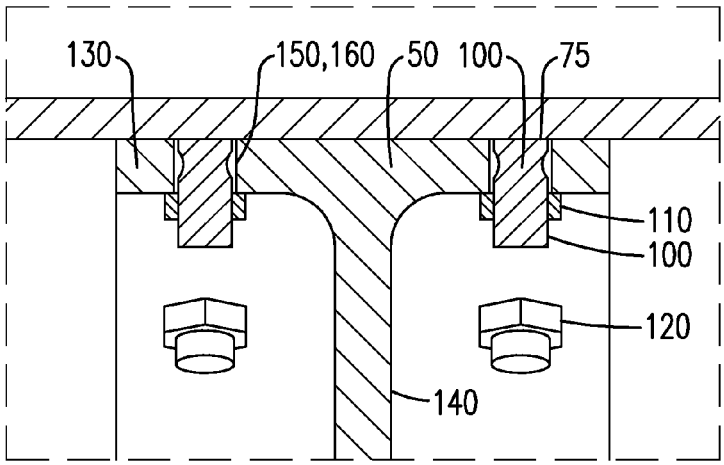
FIG. 3 illustrates a cross sectional view of a stiffening rib.

FIG. 3 illustrates a cross sectional view of an embodiment of a stiffening rib (50). In this embodiment, the stiffening rib (50) includes a T-shaped cross section. The T-shaped stiffening rib (50) includes a first planar portion (130) including a plurality of coupling holes (150, 160) used to couple the stiffening rod (50) to the surface of the flow path and a further planar portion (140) at a right angle to the first planar portion (130). The coupling holes within the first planar portion (130) of the stiffening rib (50) each may accept a welded radial threaded rod (100). The radial threaded rod (100) is welded to the surface of the flow path. In the illustrated embodiment, the welded radial threaded rod (100) is welded to an inner surface of the inner flow path (75). The welded radial threaded rod (100) is secured to the stiffening rib (50) with a corresponding washer (110) and a hex nut (120).

Figure 4:
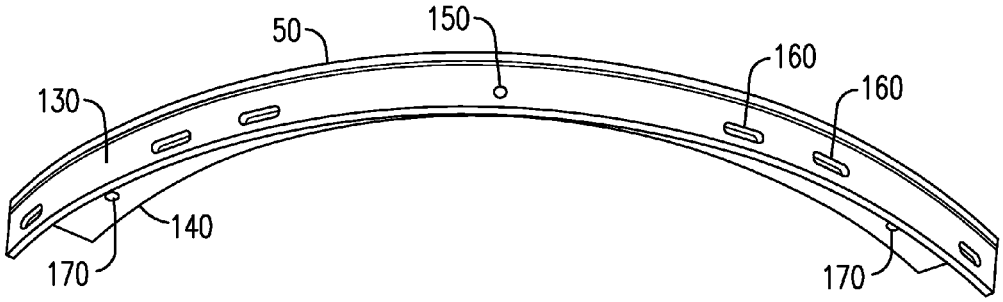
FIG. 4 illustrates a perspective view of a stiffening rib with coupling holes.

FIG. 4 illustrates an embodiment of a perspective view of a stiffening rib (50). In this embodiment, the stiffening rib (50) comprises an arcuate segment with an L-shaped cross section. The L-shaped stiffening rib (50) includes a first planar portion (130) and a further planar portion (140) at a right angle to the first planar portion (130). The first planar portion (130) includes a plurality of coupling holes (150, 160) and the further planar portion (140) includes a plurality of connection holes (170) which may be used to couple adjacent stiffening ribs (50) together.

Figure 5:
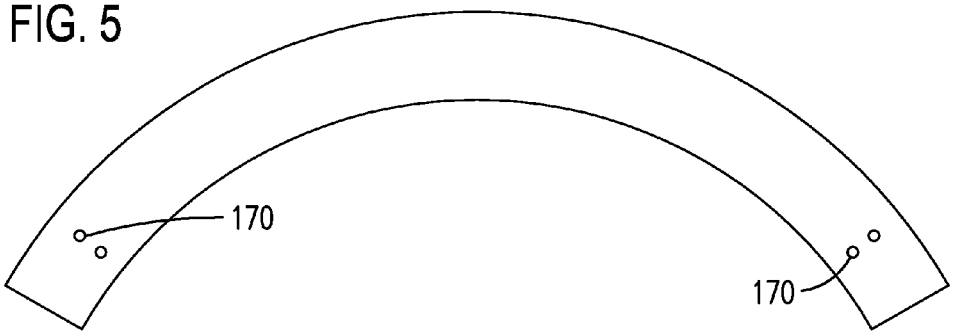
FIG. 5 illustrates a plan view of a further portion of the stiffening rib.

The further planar portion (140) of the embodiment shown in FIG. 4 is shown in FIG. 5. A plurality of connecting holes (170) may be provided in the further planar portion (140) through which a fastener may be inserted in order to install bolted connection plates (60) between adjacent stiffening ribs (50).

Figure 6:
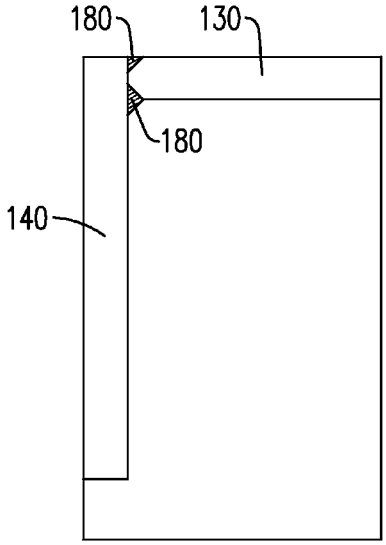
FIG. 6 illustrates a cross sectional view of the stiffening rib of FIG. 4.

A cross sectional view of the L-shaped stiffening rib (50) of FIG. 4 is shown in FIG. 6. The length of the first planar portion (130) may be, for example, approximately 76 mm and the width of the first planar portion (130) may be, for example, of 12.0 mm The further planar portion (140) is embodied at a right angle to the first planar portion (130) and is shown welded to the first planar portion (130) at two locations (180) where the two portions abut. The length of the further planar portion (140) may be, for example, approximately 127 mm and the width of the further planar portion (140) may be, for example, 12.0 mm. Ranges of the height, width, and length of the stiffening rib provided are for illustrative purposes regarding the illustrated embodiment. However, these dimensions depend on the gas turbine configuration and the desired stiffness.

Figure 7:
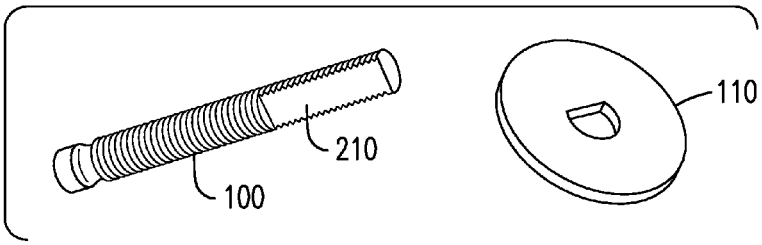
FIG. 7 illustrates a longitudinal view of a threaded welded rod and its corresponding washer.

An embodiment of a radial threaded rod (100) and its corresponding washer (110) is shown in FIG. 7. A commercially available radial threaded rod (100) such as that manufactured by NelsonStud Inc. may be used for the purpose of coupling the stiffening rod (50) to the flow path of the turbine exhaust system (10). The radial threaded rod (100) may include an end portion (210) with a semicircular profile. A washer (110) including a semicircular cut out would be used to mate with the semicircular end portion (210) of the radial threaded rod (100) in this embodiment. An advantage of using a semicircular radial threaded rod (100) and corresponding washer (110) is that the semicircular washer (110) would not be able to rotate on the stiffening rod (50) preventing the hex nut (120) from loosening and/or falling off. The hex nut (120) may be tack welded to the washer (110) in order to further secure it.

As previously mentioned, the plurality of stiffening ribs (50) may be coupled to the surface of the flow path using a plurality of coupling holes (150, 160). The positioning of the coupling holes (150,160) is a function of the geometry of the gas turbine exhaust system and the location of the stiffening ribs (50). In the embodiment of FIG. 4, the coupling holes (150, 160) include a central essentially circular hole (150) and a plurality of elongated holes (160) arranged on either side of the central hole (150). Using the central hole (150), the stiffening rib (50) may be positioned on the surface of the flow path and secured using a welded radial threaded rod (100) installed through the central hole (150). Welded radial threaded rods (100) are also installed through the elongated holes (160) to further secure the stiffening rib (50). The elongated holes (160) permit the radial threaded rod (100) to expand, and slide within the elongated hole (160), due to a differential thermal growth between the stiffening rib (50) and the surface of the flow path. For example, as the stiffening rib (50) gets hotter, the stiffening rib will bend and the welded radial threaded rods (100) will slide within the elongated holes (160).

Referring to FIGS. 1-7, a method to reduce critical panel mode response in a gas turbine casing is also provided. In an embodiment, a plurality of stiffening ribs (50) is disposed against a flow path of the gas turbine within the turbine exhaust system (10). The plurality of stiffening ribs (50) may be coupled to the flow path using a coupling scheme. In the embodiments shown in FIGS. 1-3, the stiffening ribs (50) are coupled to an inner surface of the inner flow path (75).

In order to minimize the thermal gradient between the flow path struts (40) and the stiffening ribs (50), the stiffening ribs (50) are disposed in relatively cool locations against the surface of the flow path. A high thermal gradient between the flow path struts (40) and the stiffening ribs (50) may be damaging to the stiffening ribs causing material degradation.

Each stiffening rib (50) comprises an arcuate segment with a plurality of coupling holes (150, 160) as described previously and may be positioned against the flow path in the circumferential and axial directions via the central coupling hole (150). Welded radial threaded rods (100) may then be inserted into the coupling holes (150, 160) such that the welded portion of the radial threaded rod (100) is welded to both the stiffening rod (50) and to the inner surface (75) of the inner flow path. The radial threaded rod (100) would then be secured with a hex nut (120) and washer (110).

Several stiffening ribs (50) may be coupled circumferentially around the inner surface of the inner flow path (75) creating a continuous stiffening hoop. Adjacent stiffening ribs (50) may be attached together using a bolted connection plate (60). The bolted connection plate (60) may be attached to each stiffening rib (50) via a plurality of connection holes (170) in the stiffening rib (50). Additionally, several continuous stiffening hoops may be disposed in different axial positions along the surface of the flow path in order to address specific panel modes and vibratory responses within the turbine exhaust system (10).

The casing arrangement and corresponding method provides a way to increase stiffness in the critical areas of the turbine exhaust system flow path and decrease the critical mode response without compromising the components' structural integrity. Additionally, the stiffening rib coupling scheme is retrofittable and could be installed on existing gas turbines without significant modifications to the existing hardware.

Figure 2:
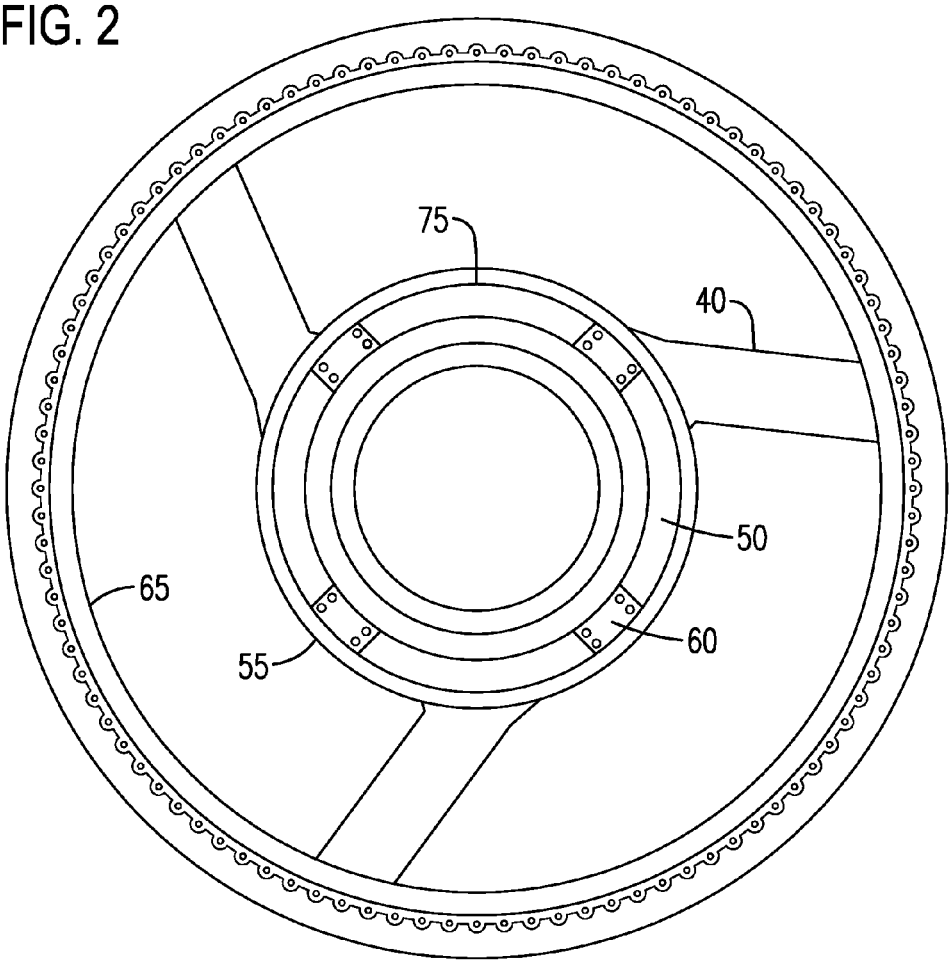
FIG. 2 illustrates a cross sectional view of the exhaust system flow path with stiffening ribs.
Figure 8:
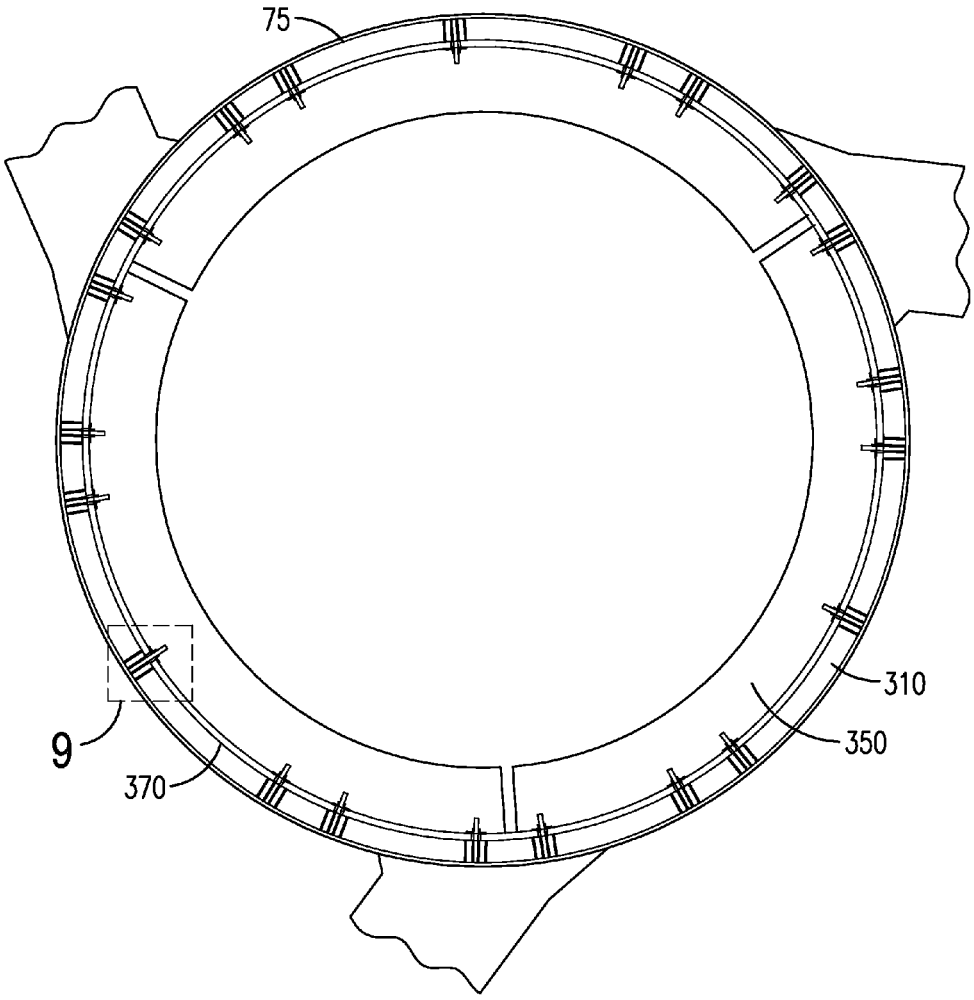
FIG. 8 illustrates a cross sectional view of the exhaust system flow path with stiffening ribs combined with a damping blanket.

In another embodiment, a casing arrangement including a damping blanket and a constraining layer is used to improve stiffness in a gas turbine, specifically the gas turbine exhaust system (10). FIG. 8 illustrates a cross sectional view of the exhaust system flow path including a damping blanket (310) and a constraining layer (350). In the illustrated embodiment the constraining layer (350) is embodied as a cylindrical plate (370) and a plurality of stiffening ribs (350), as described previously. As illustrated, the plurality of stiffening ribs (350) are disposed in a circumferential continuous hoop concentric with the cylindrical plate (370). A plurality of layers of insulation (310) including an outermost layer and an innermost layer are embodied as the damping blanket (310). One difference between this embodiment and that of FIG. 2 is that the layers of insulation (310) are directly coupled to the inner surface of the inner flow path (75). An outermost layer of insulation abuts the inner surface of the inner flow path (75) with the additional layers including the innermost layer abutting the outermost layer. Another difference between this embodiment and that of FIG. 2 is that the stiffening ribs (50) are coupled to the innermost layer of insulation instead of directly to the inner surface of the inner flow path (75). As a result of the placement of the insulation on the inner surface of the inner flow path (75) in this embodiment, the layers of insulation (310) would be circumferentially disposed between the surface of the inner flow path and the stiffening ribs (50).

Figure 9:
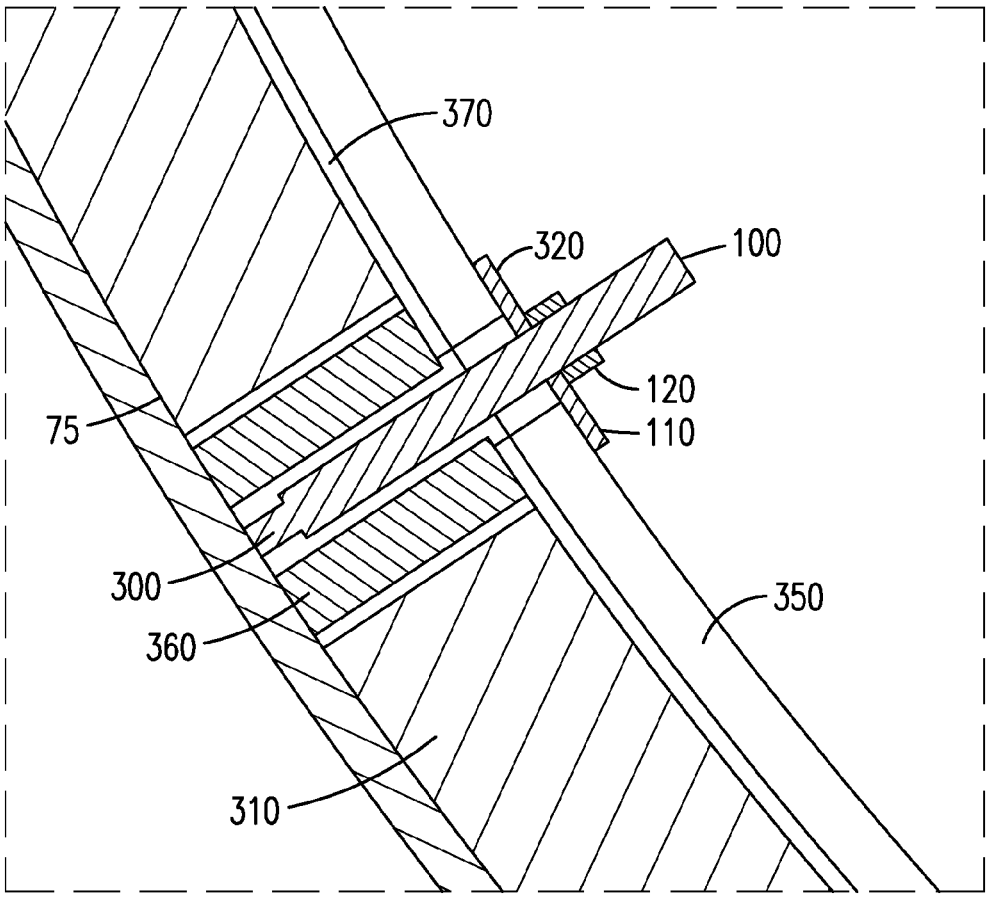
FIG. 9 illustrates an exploded view of the cross section show in FIG. 8.

FIG. 9 shows an exploded view of the damping blanket (310) and the constraining layer (350) shown in FIG. 8. A bushing (360) is disposed within an opening in the layers of insulation (310) and is inserted such that the bushing (360) makes contact with the inner surface of the inner flow path (75). The bushing ensures contact between the stiffening rib (50) and the flow path. A welded threaded rod (100) with a semicircular end portion (210) as described previously may be inserted within the opening in the bushing (360) and secured with a hex nut (120) and corresponding semicircular washer (110). The arrangement of the constraining layer along with the bushing (360) provides stiffness to the inner flow path. The cylindrical plate (370) is clamped to the layers of insulation (310) by the secured welded threaded rod (100). Sufficient clamping pressure of the cylindrical plate (370) would provide frictional damping of the vibrations of the turbine exhaust cylinder (10) and the turbine exhaust manifold (20).

The damping blanket (310) combined with the constraining layer (350) introduces a frictional damping mechanism which damps the vibrations and transfers the energy of the excessive vibrations into heat energy. The bushing (360) helps to compress the layers of insulation to a desired thickness. Friction between the layers of insulation and the inner surface of the inner flow path (75) due to the compression creates the frictional damping mechanism that converts dynamic energy to heat.

The layers of insulation used may be ceramic insulation. As an example, the thickness of the layers may be approximately 75 mm. After being compressed using the bushing (360), the thickness of the layers may be approximately 50 mm, a 33% compression. Ceramic insulation is currently used in the gas turbine exhaust system (10) to keep the internal cavity and the bearing cool. However, the layers of insulation used is not limited to ceramic insulation. Other types of insulation such as foam and metal encapsulated may be used provided that the insulation type could withstand temperatures in the ranges of 300° C. to 600° C. which is a typical temperature range that exists in the gas turbine exhaust system.

Referring to the FIGs, specifically FIGS. 8 and 9, a method to reduce vibrations in a gas turbine casing is also provided. In the illustrated embodiment, a damping blanket (310) is disposed against a flow path of the gas turbine within the turbine exhaust system (10). A plurality of stiffening ribs (350) may be coupled to the damping blanket (310) and to the flow path using a bushing (360). In the embodiment, the damping blanket (310) is coupled to an inner surface of the inner flow path (75). The method reduces the vibrations by compression of the damping blanket (310) in conjunction with stiffness provided by the stiffening ribs (350)

The damping blanket (310) may be comprised of a plurality of layers of insulation (310) including an outermost layer and an innermost layer. The outermost layer may be coupled to the inner surface of the inner flow path (75) as shown in the illustrated embodiment. The plurality of stiffening ribs (350) are coupled to the innermost layer of insulation such that the insulation is disposed between the inner surface of the inner flow path (75) and the stiffening ribs (350). One or more bushings (360) may be disposed each within an opening in the insulation (310).

Each stiffening rib (350) comprises an arcuate segment with a plurality of coupling holes as described previously and may be positioned against the innermost layer of insulation in the circumferential and axial directions using the central coupling hole. In the illustrated embodiment, the stiffening rods (100) are circumferentially coupled to the innermost layer of insulation. Radial threaded rods (100) may then be inserted through coupling holes (150, 160) in the stiffening rib (350) and into an opening in the bushing (360). The welded portion of the radial threaded rod is welded to the inner surface of the inner flow path (75). The radial threaded rod (100) would then be secured with a hex nut (120) and washer (110).

Similarly to the embodiment having the plurality of stiffening ribs (350) coupled directly to the inner surface of the inner flow path (75), several stiffening ribs (350) may be coupled circumferentially around the innermost layer of insulation creating a continuous stiffening hoop. Adjacent stiffening ribs may be attached together using a bolted connection plate (60). The bolted connection plate (60) may be attached to each stiffening rib (350) via a plurality of connection holes (170) in the stiffening rib. Additionally, several continuous stiffening hoops may be disposed in different axial positions along the surface of the flow path in order to address specific panel modes and vibratory responses within the turbine exhaust system.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A casing arrangement to improve component stiffness in a gas turbine, comprising:

a turbine exhaust cylinder;

a turbine exhaust manifold connected to the turbine exhaust cylinder establishing a fluid flow path, the fluid flow path including an inner and outer flow path; and a plurality of stiffening ribs coupled to a surface of the inner flow path effective to increase stiffness and reduce critical panel mode response, wherein the flow path is bounded by an outer surface of the inner flow path and an inner surface of the outer flow path.

2. The casing arrangement as claimed in claim 1, wherein each of the plurality of stiffening ribs are coupled to an inner surface of the inner flow path.

3. The casing arrangement as claimed in claim 2, wherein each of the plurality of stiffening ribs are coupled circumferentially around the inner surface of the inner flow path.

4. The casing arrangement as claimed in claim 3, wherein a bolted connection plate is disposed between adjacent stiffening ribs creating a continuous stiffening hoop.

5. The casing arrangement as claimed in claim 3, wherein the plurality of stiffening ribs coupled circumferentially around the inner surface of the inner flow path create a discontinuous stiffening hoop.

6. The casing arrangement as claimed in claim 4, wherein a plurality of continuous stiffening hoops are spaced axially along the inner surface of the inner flow path.

7. The casing arrangement as claimed in claim 1, wherein each stiffening rib comprises an arcuate segment including a plurality of coupling holes.

8. The casing arrangement as claimed in claim 7, wherein each stiffening rib includes a T-shaped cross section.

9. The casing arrangement as claimed in claim 7, wherein each stiffening rib includes an L-shaped cross section.

10. The casing arrangement as claimed in claim 7, wherein each stiffening rib is coupled to the flow path with a welded radial threaded rod.

11. The casing arrangement as claimed in claim 10, wherein a portion of the welded radial threaded rod includes a semi-circular cross section.

12. The casing arrangement as claimed in claim 11, wherein the welded radial threaded rod is secured to the stiffening rib with a corresponding semi-circular washer and a hex nut.

13. The casing arrangement as claimed in claim 12, wherein a central attachment hole in the center of the arcuate segment positions the stiffening rib on the flow path in the circumferential and axial directions, and wherein a plurality of elongated attachment holes are disposed on either side of the central attachment hole.

14. The casing arrangement as claimed in claim 13, wherein the plurality of elongated attachment holes permit the stiffening rib to expand accommodating differential thermal growth between the stiffening rib and the flow path.

15. A method to reduce critical panel mode response in a gas turbine casing, comprising:

disposing a plurality of stiffening ribs against a flow path of the gas turbine, the flow path defined by an inner and outer flow path; and coupling the plurality of stiffening ribs to the flow path, wherein a turbine exhaust cylinder and a turbine exhaust manifold connected to the turbine exhaust cylinder establish the flow path, and wherein the flow path is bounded radially inward by an outer surface of the inner flow path and radially outward by an inner surface of the outer flow path.

16. The method as claimed in claim 15, wherein the plurality of stiffening ribs are coupled to an inner surface of the inner flow path.

17. The method as claimed in claim 16, the disposing further comprising placing the ribs at locations on the inner surface of the inner flow path of the gas turbine such that a thermal gradient between flow path struts and the plurality of stiffening ribs is minimized.

18. The method as claimed in claim 15, wherein each stiffening rib comprises an arcuate segment including a plurality of coupling holes, and wherein the plurality of coupling holes includes a central essentially circular attachment hole disposed in the center of the arcuate segment and a plurality of elongated holes disposed on either side of the central attachment hole.

19. The method as claimed in claim 18, wherein the coupling further comprises:

positioning each stiffening rod on the flow path in the circumferential and axial direction via the central attachment hole, inserting a welded radial threaded rod into each coupling hole in the stiffening rod, securing the welded radial threaded rod within each stiffening rod with a nut and washer.

20. The method as claimed in claim 19, wherein the plurality of elongated attachment holes allow the stiffening rib to expand accommodating differential thermal growth between the stiffening rib and the flow path.

* * * * *